United States Patent [19]

Ciocarelli et al.

[11] Patent Number: 4,676,446

[45] Date of Patent: Jun. 30, 1987

[54] ADHESIVE TAPE DISPENSER PACKAGE WITH INTERLOCKING COVER MEMBERS

[75] Inventors: Mary E. Ciocarelli, Cedarburg; Nancy P. Palmer, Milwaukee, both of Wis.

[73] Assignee: W. H. Brady Co., Milwaukee, Wis.

[21] Appl. No.: 823,220

[22] Filed: Jan. 28, 1986

[51] Int. Cl.[4] ..... B65D 85/02

[52] U.S. Cl. ..... 242/55.53; 206/408; 206/470

[58] Field of Search ..... 206/461, 467, 470, 408; 242/1, 55.53, 71.1, 197; 225/39, 41, 43, 46, 47, 48, 50, 51, 52; 221/70, 71, 72, 73; 220/4 B

[56] References Cited

U.S. PATENT DOCUMENTS

| | | | |
|---|---|---|---|
| 1,185,490 | 5/1916 | Everhart | 225/52 X |
| 3,754,643 | 8/1973 | Foster | 221/70 X |
| 3,820,738 | 6/1974 | Collins | 242/71.1 X |

*Primary Examiner*—Stuart S. Levy
*Assistant Examiner*—Katherine Matecki
*Attorney, Agent, or Firm*—Quarles & Brady

[57] ABSTRACT

A package (10) for a roll of adhesive tape (65) consisting of a unitary structure having a first cover member (11) and a second cover member (12) foldable into a superimposed condition to form a tape storage compartment (70) and a tape exit slot (71) through which the tape (65) is lead to an outer edge of the package to be withdrawn from the package. The cover members include ridge (21) and channel (41, 52) elements that interlock with one another to hold the cover member (11, 12) in a closed condition.

7 Claims, 12 Drawing Figures

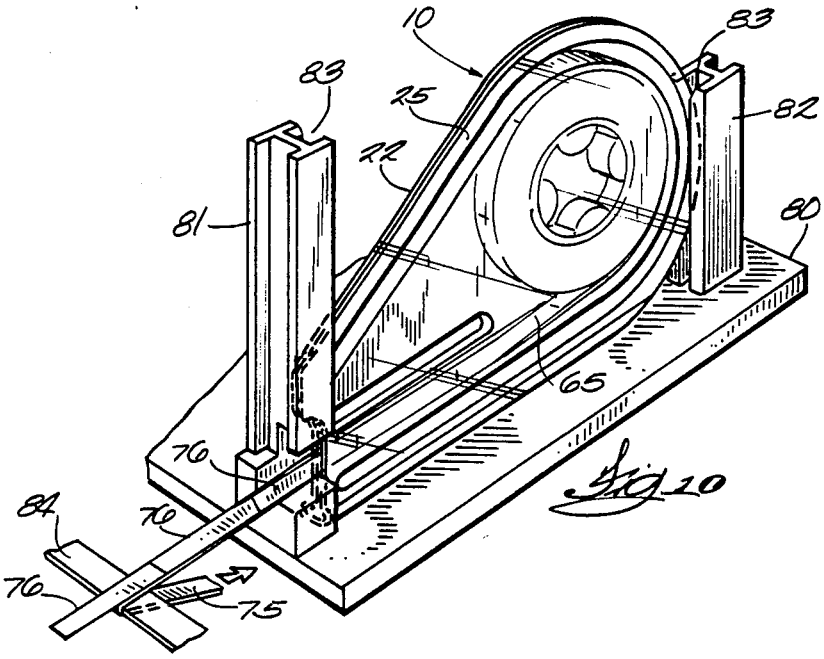
Fig. 10
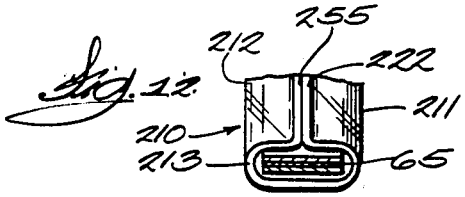
Fig. 12
Fig. 11
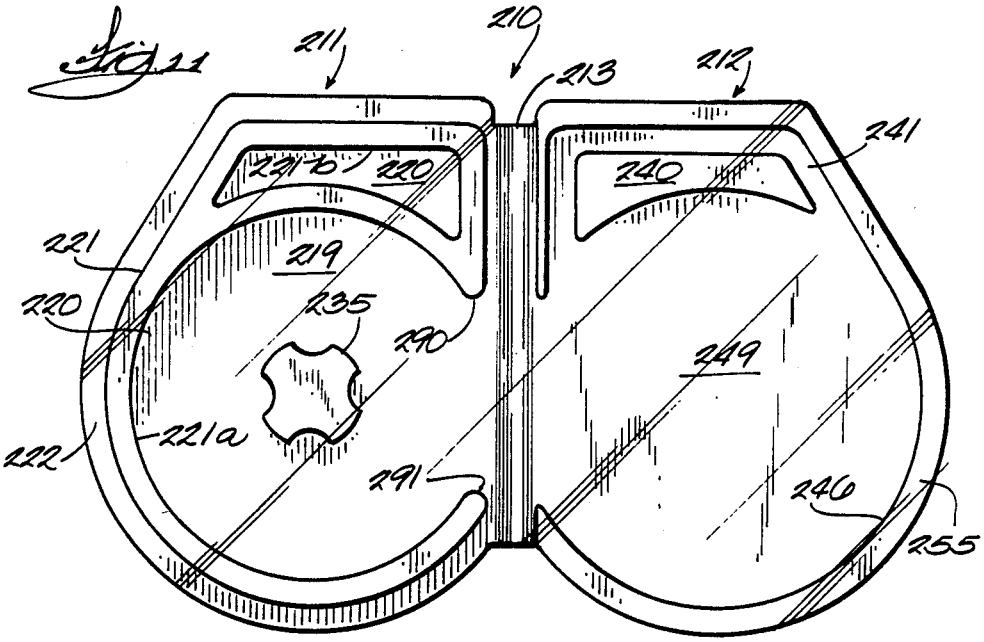

ADHESIVE TAPE DISPENSER PACKAGE WITH INTERLOCKING COVER MEMBERS

TECHNICAL FIELD

This invention relates to packages for storing a roll of adhesive tape, which packages are also suitable for dispensing the adhesive tape by withdrawing it from the package.

BACKGROUND ART

An example of one type of adhesive tape roll packed in a dispenser package comprises a group of adhesive articles supported on a carrier web. A known construction used to package rolls of this product is a so-called "blister pack" consisting of a thermoformed plastic element having a peripheral flange that is joined to a flat base element typically made of chipboard. The plastic element is formed to include a housing section in which a roll is stored and an exit portion through which the carrier web is led and thereafter bent around an edge of the base element so that an adhesive article will separate from the carrier web; the adhesive article is then removed from the carrier web and applied to an object. Especially useful packages of this type are disclosed in the following patents assigned to the assignee of the present invention: U.S. Pat. No. 3,743,086, Adhesive Tape Dispenser Package; U.S. Pat. No. 4,271,962, Tape Dispenser Package With Roll Restraining Friction Disc; U.S. Pat. No. 4,279,259, Tape Dispenser Package With Restraining Covers; and U.S. Pat. No. 4,286,729, Tape Dispenser Package With Core Friction Ring.

Packages made according to one or more of the above patents have been commercially successful and have proved effective. However, we have become aware of certain limitations of the blister-pack construction which have led us to perceive of the need to devise an improved package. For example, the plastic element cannot be separated from the chipboard base element without destroying the package; this prevents the roll of tape product stored in the package from being checked without destroying the package, and makes it impossible to reuse the package for additional rolls of product once the first roll packed therein has been exhausted. Also, the adhesive tape is dispensed from the package by drawing it against an edge of the base element; the chipboard base element can wear down or tear during extended use, and such damage can prevent dispensing the entire length of a long roll of tape stored in the package. Thirdly, the blister-pack consists of two separate elements, thereby resulting in inventory problems, particularly since the chipboard base element is typically printed with graphic and informational material that can vary from product to product or customer to customer. Another difficulty is that the special equipment and techniques needed for the final packaging of the blister-pack style of package often will require that the packaging be done by a specialist company other than the manufacturer of the adhesive products to be stored in the package. There is an added problem in that each package must be tailored to the specific article or size of article to be carried therein, so that the manufacturer of the adhesive products can often find it difficult to carry a stock inventory in the absence of orders from specific customers. Our analysis of these and other problems associated with the blister-pack package was the impetus for our development of the package which is about to be described. The principal objects of the present invention were to develop a new package suitable for storing a roll of adhesive tape that would obviate the foregoing and other disadvantageous characteristics of the blister pack style of package and to provide suitable specific package constructions.

SUMMARY OF THE INVENTION

Our present invention provides a unitary package comprising first and second cover members which are hinged together so as to be foldable upon one another to a closed condition. The construction is made of formed plastic material, and the cover members include interlocking means consisting of ridge means and channel means formed as integral portions of the cover members. Thus, one cover member is formed to include a ridge means that defines a storage compartment and an exit portion. The other cover member is formed to include a channel means that is a mirror image of parts of the ridge means of the one cover element. The two cover members are held together upon being folded over one another by interlocking of the channel means formed in one cover with mating portions of the ridge means formed in the other cover. Further, the ridge and channel means formed in the two cover members define a storage compartment for a roll of adhesive tape to be retained in the package when closed and also to define an exit slot through which the tape can be drawn to be dispensed from the package.

DESCRIPTION OF THE DRAWINGS

The present invention is fully disclosed in the following description made by reference to the accompanying drawings, in which:

FIG. 10 is a perspective view of the package of FIGS. 1–8 when used for mechanical dispensing of tape;

FIG. 11 is a plan view of a second embodiment of an adhesive tape dispenser package according to the present invention, illustrated in its open condition; and FIG. 12 is a vertical end view of a portion of the package of FIG. 11 in its closed condition.

BEST MODES FOR CARRYING OUT THE INVENTION

Figure 1:
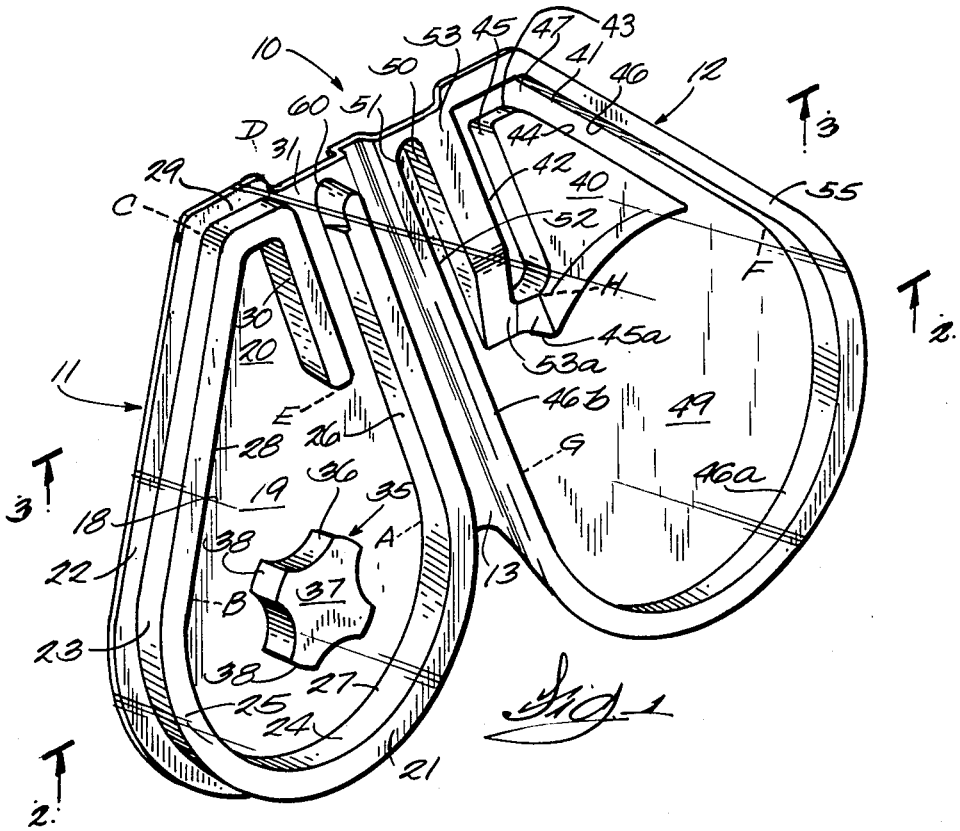
FIG. 1 is a perspective view of a unitary package of the present invention shown in its open condition.
Figure 2:
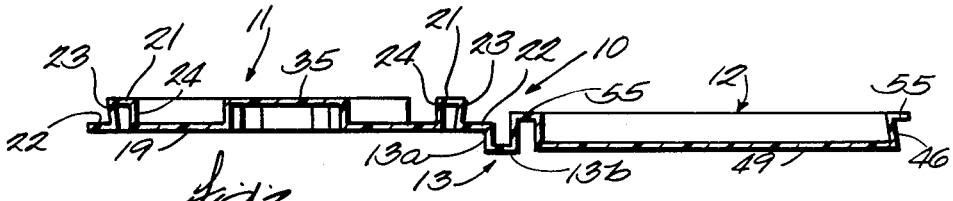
FIG. 2 is a sectional view of the package of FIG. 1 taken along the plane of line 2—2 of FIG. 1.
Figure 3:
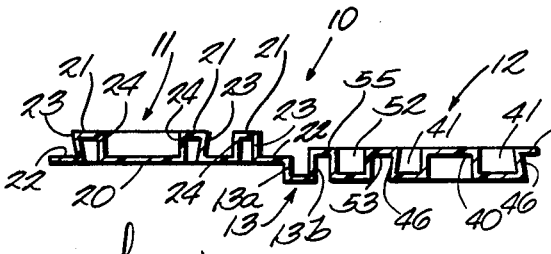
FIG. 3 is a sectional view of the package of FIG. 1 taken along the plane of line 3—3 of FIG. 1.

FIGS. 1, 2 and 3 illustrate a package 10 according to the present invention which includes a first cover member 11 and a second cover member 12 connected together along a medial foldable web 13. The package 10 is illustrated in its flat open condition as it would appear after manufacture and before being closed to package a roll of adhesive tape. In the closed package, the first member 11 will form one cover of the package enclosure and the second member 12 will form the other cover of the package enclosure. The package 10 is to be made of plastic materials which can be thermoformed, using vacuum and/or pressure, or molded to define the various structural elements which are further described. The package 10 can be made of thermoformable or moldable plastic materials such as, but not limited to polyvinyl chloride, polystyrene, PETG polyester, polypropylene, polyethylene, cellulose propionate, cellulose acetate, cellulose butyrate, polycarbonate, polybutylene terephthalate, ABS, and coextrusions of 2 or more such materials. The plastic used for the package can be transparent or opaque.

First cover member 11 of the package 10 includes a flat main web 18 comprising a circular lower panel 19 and a generally triangular upper panel 20 which are joined to and co-planar with one another, a raised ridge 21 that surrounds most of the main web 18 and extends above the main web as viewed in FIGS. 1-3, and a flange 22 that extends about the most of the periphery of first member 11 and is in the same plane as the main web 18. The ridge 21 has spaced sidewalls comprising outer sidewall 23 and inner sidewall 24 that extend from the main web 18 and are connected together by a top wall 25. The top wall 25 is thereby spaced from the main web 18 by the height of the sidewalls 23 and 24. Flange 22 extends from the outer sidewall 23 of the ridge and is located in the plane of the web 18.

The ridge 21 is formed as an integral part of the first member 11 and has several sections connected together end-to-end to form a continuous ridge: a relatively long first straight section 26 located parallel to foldable web 13; a curved section 27 extending from the end of section 26 (indicated by dashed line A); a second straight section 28 that extends from the end of curved section 27 (line B) and is inclined towards first straight section 26; a short third straight section 29 extending from the end of section 28 (line C) towards and perpendicular to section 26; a fourth straight section 30 extending from the end of section 29 (line D) and parallel to and spaced from first straight section 26, to terminate in a curved end at line E. Panel 31 of the central web 18 of the first element is located between and connects sections 26 and 30 of the ridge 21. Outer sidewall 23 and inner sidewall 24 meet to form a rounded end to the ridge 21 along the top of the package at the beginning of section 26 and meet to form a rounded end to the ridge at the end of section 30. Flange 22 extends from sidewall 23 along sections 26-29 of the ridge 21 and connects element 11 to the foldable web 13.

A circular hub 35 is formed centrally of the circular panel 19 and comprises a vertical wall 36 extending from web 18 of the first member 11 and a top wall 37. The vertical wall 36 may be formed to have teeth 38 as shown in the drawings, such as described in the aforementioned U.S. Pat. No. 4,279,359, to adjust the tension on and aid in retaining a roll of adhesive tape on the hub; also, however, the vertical wall 36 can have other configurations and may, for example, comprise an edentate circular wall.

The second cover member 12 of the package 10 is formed to include a generally triangular upper panel 40 surrounded by a first channel 41 comprising three sections connected together end-to-end to form a continuous channel: a first straight section 42 positioned parallel to and spaced from the foldable web 13, a second straight section 43 perpendicular to section 42, and a third straight section 44 that is inclined relative to section 43. The channel 41 is defined by an inner sidewall 45 and an outer sidewall 46 spaced from wall 45; bottom wall 47 connects and extends between the inner wall 45 and outer wall 46 to complete the channel 41.

Outer sidewall 46 of the second cover member continues beyond the channel 41 to include a curved section 46a between dashed lines F and G to surround and define part of the boundary of a circular panel 49 that is integral with and in the same plane as bottom wall 47. A straight section **46*b* of the outer sidewall 46 extends from the terminus of circular section 46*a* (line G) to the upper end of the second cover member and is parallel to the foldable web 13. Circular panel 49 is also bounded by a curved section 45*a* of the inner sidewall 45, which is joined to a side of the triangular upper panel 40**.

A second inner sidewall 50 is spaced from a portion of section **46*b* of the outer sidewall 46 and joined thereto by bottom wall 51 to define therebetween a second channel 52. Bottom wall 51 is integral with and in the same plane as panel 49 of the second element. Second inner sidewall 50 is parallel to the foldable web 13 and parallel to section 46*b* of the outer wall 46**.

The edge of second inner sidewall 50 remote from bottom wall 51 and the edge of vertical outer wall 46 remote from bottom wall 51 are connected together by panel 53 that is in the same plane as triangular panel 40. The inboard portion **53*a* of panel 53 is shown as being inclined and extending to join circular panel 49** (see also FIG. 7) to form a ramp for a purpose to be described hereinafter.

A flange 55 extends about most of the periphery of outer sidewall 46 starting along section 43 of channel 41 and joining second cover member 12 to the foldable web 13. The flange 55 is in the same plane as triangular panel 40.

FIGS. 4-7 illustrate the package 10 in its closed condition with a roll of adhesive tape 65 stored inside the package. The first step in forming the closed package is to insert the roll 65 onto the hub 35 of cover member 11 while the package is in its open condition illustrated in FIG. 1. After the roll 65 has been placed onto the hub, the tape is led from the roll 65 across panel 31 of the first element in between sections 26 and 30 of the ridge 21 to project beyond the boundary of the package. Next, second cover member 12 is hinged about foldable web 13 to be positioned above and superimposed upon first cover member 11 of the package, following which the second cover member 12 is pressed further towards the first cover member so that channels 41 and 52 thereof interlock with portions of ridge 21 of the first cover member. The package can be closed manually or mechanically with an appropriate fixture; it has been found helpful to narrow an end of ridge 2 slightly such as shown at 60 (somewhat exaggerated) in FIG. 1 so that channel 52 will more easily engage the ridge to facilitate closing. In the closed condition, channel 41 of the second cover member engages sections 29 and 30 and part of section 28 of the ridge 21 and channel 52 of the second cover engages part of section 26 of the ridge 21. These sections of the ridge 21 are nested within channels 41 and 52 in snug fashion so as to hold the package 10 in the closed condition of FIGS. 4-7. The cross-sectional dimensions of ridge 21 and channels 41 and 52 are selected so as to obtain a press fit, or snug fit, when the cover members are closed. Also, to hold the package in the closed condition, at least a portion of one of the sidewalls 23 or 24 of the ridge 21 of the first cover member is angled away from the other sidewall. Thus, referring now to FIGS. 1–3, inner sidewall 24 of the ridge is vertical throughout its length, i.e. sidewall 24 is perpendicular to main web 18 of the first cover member. However, outer sidewall 23 is angled away from sidewall 24 along its portion extending from line A to line E. This angled relationship of sidewall 23 relative to sidewall 24 is most clearly seen in the cross sectional views of FIGS. 2 and 3. The particular angle of the inclination of the sidewall can vary with the height of the ridge 21. For example, in a specific package made according to this invention with a ridge about 3/16 inches high, the angle of inclination from the vertical for this section of sidewall 23 was 7°; a higher ridge can have a smaller angle of inclination. With respect to the second cover member 12, the section of outer sidewall 46 from line H to line G has the same angle of inclination as the inclined portion of sidewall 23 so as to mate therewith, again as best shown in FIGS. 2 and 3. Inner sidewall 45 and second inner sidewall 50 are vertical. Thus, the first channel 41 of the second cover member 12 includes a sidewall that is inclined at the same angle as sidewall 23, as well as the portion of outer sidewall 46 that is not included as part of channel 41. When the cover members are in their superimposed closed condition, referring now to FIGS. 5 and 6, the angled portions of the sidewalls of the two cover members interlock to engage or mate with one another as illustrated in these drawings. This combination of angled and vertical sidewalls of the ridge 21 and mating sidewall portions of the second cover member allows the ridge and channel means to interengage so as to retain the cover members in their superimposed closed condition. When the second cover member is pressed fully into engagement with the first cover member, flange 55 of second cover member 12 will contact flange 22 of first cover member 11 and section 46*a* of outer sidewall 46 of the second cover member will engage curved section 27 of the ridge 21. Cover members 11 and 12 are thusly snapped together in sufficiently firm engagement to form a closed package which is capable of remaining closed during its normal use.

In order to facilitate the folding of the cover members 11 and 12 to form a closed package as described above, the foldable web 13 joining together the two cover members is usefully formed to have a cross-sectional configuration best illustrated in FIGS. 2 and 3. The foldable web 13 is an integral web comprising an L-shaped section 13*a* depending from flange 22 of the first cover member 11 that is connected to an L-shaped section 13*b* depending from flange 55 of the second cover member. When the web 13 has this cross-sectional configuration, it will form a web having a generally circular, or oval-shaped, cross-section when the cover members 11 and 12 are superimposed and interlocked with one another as described above, which configuration is best illustrated in the partial perspective view of FIG. 9.

The package 10 is retained in its closed condition by the nesting interlocking engagement between the ridge and channel elements of the two cover members. This type of closure is achieved by selection of plastic material for the package that has sufficient rigidity and resilience, as well as by appropriate design of the ridge and channel elements. Thus, no mechanical fasteners, adhesive, or other fastening means need to be used in order to keep the package closed. The elimination of fastening means, as well as heat sealing or bonding between the cover members, results in another important functionality of the package 10, namely that it can be opened manually to inspect or replace the roll of adhesive tape when a roll is exhausted, or to change the tape, without destroying the package. However, if nondestructive reopening is not to be a feature of a particular package application, the cover members can be sealed to one another or otherwise bonded or fastened together, such as along panels 20 and 40 and panel 49 and top wall 37 of the hub 35, to form a package that cannot be reopened. Thus, the package 10 is capable of being produced in either configuration.

Figure 4:
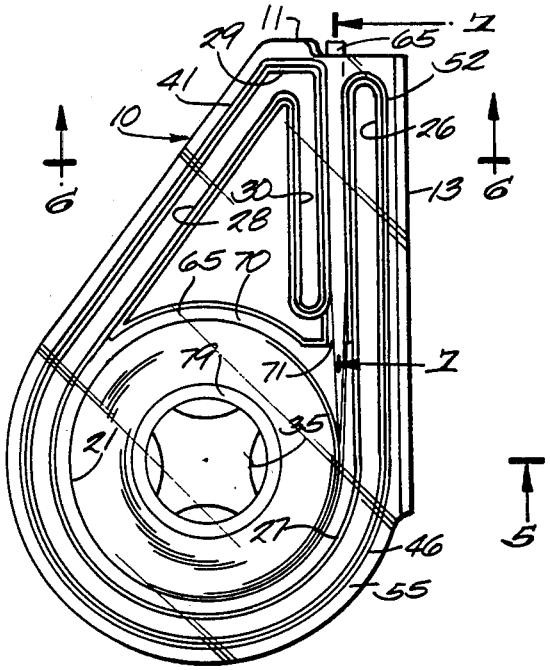
FIG. 4 is a plan view showing the package of FIG. 1 in a closed condition with a roll of adhesive tape supported therein.
Figure 5:
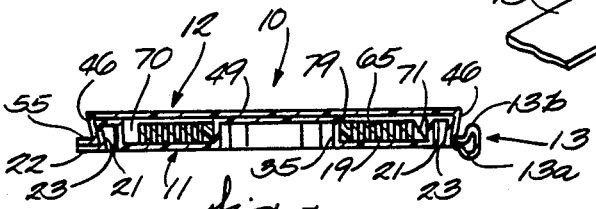
FIG. 5 is a sectional view of the closed package taken along the plane of line 5—5 in FIG. 4.
Figure 6:
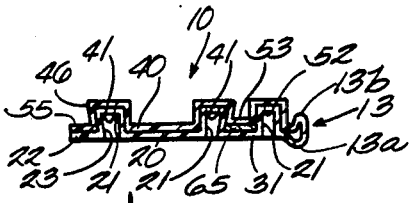
FIG. 6 is a sectional view of the closed package taken along the plane of line 6—6 of FIG. 4.
Figure 7:
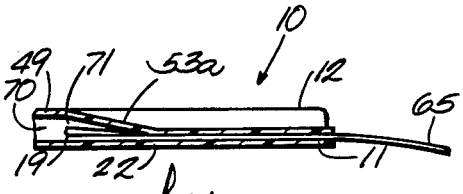
FIG. 7 is a longitudinal sectional view of the closed package taken along the plane of line 7—7 of FIG. 4.

The closed package 10 forms a tape storage compartment indicated by the general reference numeral 70 in FIGS. 4, 5 and 7 that has sidewalls defined by circular lower panel 19 of the first cover member 11 and circular panel 49 of second cover member 12 which are spaced from one another when the package is closed by the height of the ridge 21. An outer end wall of the tape storage compartment 70 is provided by curved section 27 of the ridge 21 and an inner end wall of the compartment 70 is defined by curved section 45*a* of inner sidewall 45 of the second cover member 12. It will be noted from FIG. 6 that triangular panel 40 of the second cover member contacts triangular panel 20 of the first cover member when the package is enclosed to thereby locate the curved section 45*a* of cover 12 in position so as to close off a minor portion of the circular tape compartment 70. The hub 35 is located within the tape storage compartment, preferably centrally thereof.

Further, when the cover members 11 and 12 are engaged with one another to form the closed package 10 of FIGS. 4–7 and 9, the cover members also define a tape exit slot 71 that leads from the tape storage compartment 70 to an exterior boundary of the package. As best illustrated in FIG. 6, the tape exit slot 71 is defined by panel 31 of the first cover member and panel 53 formed as an integral part of second cover member 12. Panels 31 and 53 are sufficiently spaced from one another when the package is closed so as to permit the tape 65 to extend between the panels and to be withdrawn from the package 10, and they can be close together when it is desired to apply restraining force against the tape. Since most adhesive tapes will be rather thin, generally in the range of 4 to 20 mils total thickness, the spacing between panels 31 and 53 will generally be quite small. The reason for inboard portion 53*a* of panel 53 being inclined and extending to join circular panel 49 of second cover member 12 is best illustrated in FIG. 7. Inboard portion 53*a* is inclined to extend between circular panel 49 and the balance of panel 53 so as to form a ramp that will serve to guide the tape 65 from the tape storage compartment and into the tape exit slot 71. This ramp construction is a utilitarian feature, and desirable although optional in the finished package, inasmuch as it aids in a smooth transition of the tape 65 from a vertical position while the roll of tape is held on the hub 35 to a horizontal position as it comes off the roll and is lead through the tape exit slot 71.

Figure 8:
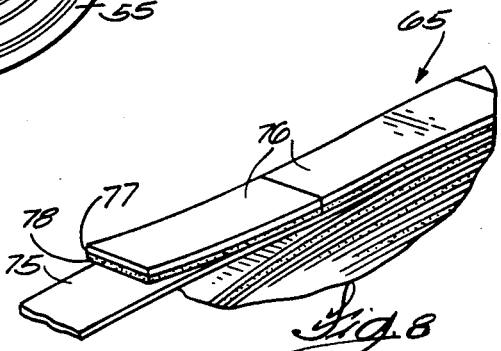
FIG. 8 is a partial perspective view of one type of roll of adhesive tape that can be stored in the package.

The exemplary adhesive tape 65 illustrated in the drawings is shown in detail in the partial perspective view of FIG. 8. The tape 65 comprises a carrier web 75 on which are supported a plurality of adhesive articles 76 each comprising a top layer 77, which can be of plastic film, metal foil, paper, etc., and a layer of pressure-sensitive adhesive 78 which is releasably joined to the carrier web 75 so as to retain the adhesive articles 76 on the carrier web but yet permit the adhesive articles to be removed from the web for application to an object without deleterious delamination of the adhesive 78 from the top layer 77. The carrier web may be release coated if necessary so that the adhesive 78 will cleanly release without transfer of adhesive to the carrier web, or a release coating on the carrier web may not be needed if the type of material used for the web is such that the desired clean release of adhesive can be obtained. As shown in FIG. 8, a plurality of adhesive articles 76 are arranged end-to-end on the carrier web, but the adhesive articles may be spaced from one another along the carrier web if so desired. The tape 65 is illustrated as being wound into roll form on a core 79 (FIG. 4). The adhesive tape 65 is shown as an exemplary type of adhesive tape that can be stored in the package 10. However, it is to be understood that other types of adhesive tapes can be stored in a package 10 of the present invention.

Figure 9:
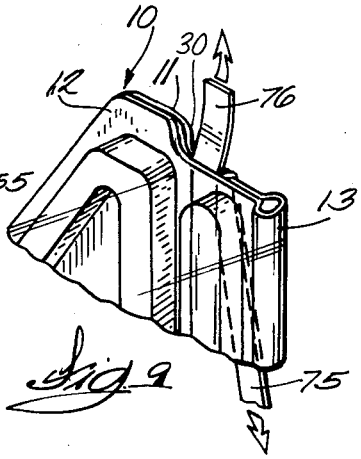
FIG. 9 is a perspective view of a portion of the package showing the dispensing of adhesive articles from the roll carried in the package of FIGS. 1–8.

The dispensing of the tape 65 from the package 10 is best illustrated in the perspective view of FIG. 9. The tape 65 is manually withdrawn through the tape exit slot 71 about an outer edge of the package 10, with the carrier web 75 thereof contacting panel 31 of cover member 11. As the tape crosses the edge of the package, which is a clean cut edge, the tape is pulled downwardly approximately along the rear of the package. This bending action causes the adhesive articles 76 to separate from the carrier web 75 so that an individual adhesive article can be removed from the carrier web, either manually or mechanically, for application to an object. Panels 31 and 53 are close to one another so as to apply a restraining force on the tape to aid this type of dispensing action. In FIG. 9, it will be noted that the flange 22 has an end portion 30 alongside the tape exit slot 71 that acts as a vertical edge guide to direct the tape out of the slot. Either or both flanges can have an end wall arranged for this purpose. In a specific use of a package 10 of this invention, the tape 65 included a carrier web comprising a strip of polyester film about two mils thick, and adhesive articles comprising of polyester film about either 0.3 or 0.5 mils thick with an aluminized coating on its bottom surface and a layer of pressure sensitive adhesive coated over the aluminum coating. The adhesive articles were designed 5to be adhered to magnetic recording tape to provide a means to sense the beginning and/or the end of the recording tape. It was found that the package 10 provided effective storage for the adhesive tape and facile dispensing of adhesive articles from the package in the manner described above.

The package 10 is adapted for both manual and mechanical dispensing of tape. The package can be held in one hand in the position shown in FIGS. 4 and 9 and the tape withdrawn from the package with the other for manual dispensing. Mechanical dispensing is illustrated in FIG. 10. A fixture 80 includes front and rear vertical supports 81 and 82, respectively, the two supports having vertical slots 83 facing one another. A closed package 10 is positioned in the supports with the mating flanges 22 and 55 at the front of the package inserted in slot 83 of front support 81, and the mating flanges at the back of the package inserted in slot 83 of the rear support 82. The package 10 is thereby held in a vertical condition in the fixture 80. Tape 65 is led from the package beyond the front support 81, rotated 90° to a horizontal position and then led over a sharp edge, such as bar member 84, so that the adhesive articles 76 will separate from the carrier web 75 and can be applied mechanically to an article, such as with a roller.

FIGS. 11 and 12 illustrate a package 210 as a second embodiment of the present invention, comprising a first cover member 211 and second cover member 212 connected together along a medial foldable web 213. (The elements of package 210 described herein that are the same or similar to the various elements of the package 10 are denoted by the same reference numeral with the prefix "2".) First cover member 211 includes a ridge 221 comprising a curved main section **221*a* and a 3-sided upper section 221*b* that surrounds upper panel 220. The curved main section 221*a* surrounds lower panel 219 to define the boundary of a tape storage compartment 270 within which a hub 235 is centrally located. Ridge 221 has a first end 290 and a second end 291 spaced from the first end, the ends 290 and 291 being positioned alongside the foldable web 213. Lower panel 219 and upper panel 220 of the first cover member are in the same plane. Flange 222 extends about most of the outer periphery of the ridge 221. The second cover member 212 is formed to include a first channel 241 that is positioned to interlock with portions of ridge 221 when the package is in its closed position, upper panel 240 that is to contact upper panel 220 when the package is closed, and circular panel 249 that is spaced from panel 219 to define a side of the tape storage compartment 270 when the package is closed. Outer sidewall 246 extends from the channel 241 about circular main panel 249 and is to contact the outer sidewall of ridge 221 when the package is closed. Ridge 221 has a combination of vertical and inclined sidewall portions as does sidewall 246 and channel 241, as previously described in connection with package 10. Flange 255 extends about most of the periphery of outer sidewall 246 and is to contact flange 222** when the package is closed.

FIG. 12 illustrates the package 210 in its closed condition with the cover members 211 and 212 superimposed upon one another. Foldable web 213 forms a circular, or oval, cross-sectional shape when the two cover members are superimposed and locked together in this fashion. Tape 65 from a roll thereof carried on hub 235 is led between spaced ends 290 and 291 of the ridge 221 through the circular or oval tube formed by web 213 when it is folded with the two covers in their superimposed closed condition. In comparison to package 10 of the first embodiment, the tape 65 is not rotated 90° as it is withdrawn from the roll on the hub, and the tape will remain in the vertical plane as it is dispensed from the package when viewing the closed package in plan view similar to FIG. 11.

There has thus been described new constructions for a package for storing and dispensing adhesive tape consisting of a unitary structure combining first and second cover members which are hinged together so as to be foldable from a side-by-side open condition (FIGS. 1 and 11) to a superimposed closed condition (FIGS. 4 and 12). The two cover members are retained in the closed condition by interlocking means consisting of ridge means formed on one member and channel means formed on the other cover member so that the ridge means is received within the channel means in a snug fitting relationship to thereby hold the cover members in the closed condition. The closed package also utilizes the ridge and channel means of the two cover members to define a storage compartment for a roll of adhesive tape and an exit slot leading from the storage compartment to an edge of the package through which adhesive tape is led for dispensing from the package.

The new adhesive tape packages of the present invention have a number of significant advantages not now found in known tape storage packages. A unitary package can be presented to the tape manufacturer, consisting of a single blank forming the two cover members and the respective ridge and channel means, thereby eliminating the two separate package elements of the prior constructions. Also, a roll of adhesive tape can be inserted into the open package and the package closed to form the complete package assembly in an easy operation without the need for any special packaging machinery; this feature will facilitate the assembly of the final package and allow final assembly to be done by the tape manufacturer. Thirdly, the package can be readily provided with various types of identification or informational graphics by using labels adhered to outer surfaces of the package; this feature allows a single package to be used for a variety of products merely by varying the labels, instead of requiring custom-made package elements for each product. Also, this latter feature will enable a manufacturer of adhesive tape to prepack rolls of tape in plain packages and add the identifying labels upon receiving an order from a specific customer, which has the advantage of allowing the tape manufacturer to build a stock inventory in preparation for the receipt of orders from various customers. The adhesive tape packages of this invention, as described above, provide for safe storage of a roll of adhesive tape and the ready dispensing of tape from the package. The ridge and channel elements are configured and dimensioned so as to firmly hold the two cover members in their closed condition. Moreover, however, packages of the present invention can be reopened after having been closed, which is an advantage in that it enables the user to put a fresh roll of adhesive tape into the package after a roll has been exhausted. In addition, this latter feature enables the adhesive tape stored in the package to be checked, such as part of quality control by the tape manufacturer, without destroying the package.

The foregoing detailed description sets forth several specific embodiments of the present invention to fully teach its principles to those knowledgeable in the art. However, since numerous modifications and changes will readily occur to those of ordinary skill in the art, it is not desired to limit the invention to the exact constructions and operations herein described, and accordingly, all suitable modifications and equivalents may be restored to fall within the scope of the invention as claimed.

We claim:

1. A package for storing and dispensing a roll of adheasive tape comprising, in combination:

(1) a first cover member and a second cover member connected together and foldable between a side-by-side open condition and a superimposed closed condition, the first and second cover members including wall panels defining an enclosed tape storage compartment and a tape exit slot leading from the tape storage compartment to an outer edge of the package when in the closed condition;

(2) support means for a roll of adhesive tape in the tape storage compartment, the support means consisting of an element formed as an integral portion of one of the cover members;

(3) interlocking means for holding the first and second cover members together in the closed condition, the interlocking means consisting of ridge means formed as an integral portion of one cover member and channel means formed as an integral portion of the other cover member, with the ridge means being received in the channel means to hold the cover members in the closed condition;

(4) the ridge means including two spaced parallel sections defining two edges of the tape exit slot, and the wall panel of one cover member defining the tape exit slot connecting the parallel sections of the ridge means to define a first wall of the tape exit slot; and (5) the channel means including two spaced channels engageable with the two spaced parallel sections of the ridge means when the package is in the closed condition, and the wall panel of the other cover member defining the tape exit slot connecting the channels to define a second wall of the tape exit slot.

2. A package according to claim 1, wherein:

the wall panels of the first cover member include a circular panel defining a first wall of the tape storage compartment, and a second panel integral and co-planar therewith;

the wall panels of the second cover member include a circular panel defining a second wall of the tape storage compartment, and a second panel spaced therefrom along a curved inner sidewall, and in the closed condition the circular panels of the two cover members are spaced from each other by the ridge means and define the tape storage compartment, and the second panels of the two cover members contact each other alongside the tape storage compartment.

3. A package according to claim 2, wherein: the ridge means defines an outer end wall of the tape storage compartment, the circular panels of the first and second cover members define spaced sidewalls of the tape storage compartment, and the curved inner sidewall of the second cover member defines an inner end wall of the tape storage compartment.

4. A package according to claim 1, 2, or 3, wherein:

the first and second cover members each includes a flange extending about the major portion of the periphery thereof, the flanges contact each other in the closed condition of the cover members, and at least one flange includes an end portion alongside the tape exit slot.

5. A package according to claim 1, 2, or 3 wherein:

the ridge means includes spaced first and second sidewalls connected together by a top wall, the first sidewall is vertical and the second sidewall includes a vertical portion and an inclined portion;

the channel means includes spaced first and second sidewalls connected together by a bottom wall, and portions of the first and second sidewalls of the channel means that contact the ridge means when the package is in the closed condition are vertical or inclined to match mating portions of the first and second sidewalls of the ridge means.

6. A package according to claim 1, 2, or 3, further including:

a foldable web connecting the first cover member and the second cover member and along which the cover members are foldable to the closed condition.

7. A package according to claim 6, wherein;

the foldable web includes a first portion connected to the first cover member and a second portion connected to the second cover member, the first and second portions of the foldable web have an L-shaped cross-section, and the foldable web is generally circular in cross-section when the cover members are in the closed condition.

* * * * *